US008041249B2

(12) United States Patent
Hara

(10) Patent No.: US 8,041,249 B2
(45) Date of Patent: Oct. 18, 2011

(54) DEVELOPER COLLECTING/CHARGING DEVICE, IMAGE FORMING APPARATUS AND CLEANING METHOD

(75) Inventor: Kazuyoshi Hara, Itami (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 714 days.

(21) Appl. No.: 12/132,418

(22) Filed: Jun. 3, 2008

(65) Prior Publication Data

US 2008/0298832 A1 Dec. 4, 2008

(30) Foreign Application Priority Data

Jun. 4, 2007 (JP) ..... 2007-147952

(51) Int. Cl.
*G03G 15/16* (2006.01)

(52) U.S. Cl. ..... 399/101

(58) Field of Classification Search ..... 399/101, 399/128, 129, 302
See application file for complete search history.

(56) References Cited

U.S. PATENT DOCUMENTS

| | | | | |
|---|---|---|---|---|
| 5,809,373 | A * | 9/1998 | Yoda et al. | 399/101 |
| 5,845,172 | A | 12/1998 | Saito et al. | |
| 5,991,566 | A * | 11/1999 | Tanaka et al. | 399/129 |
| 6,308,019 | B1 | 10/2001 | Miyashiro et al. | |
| 2007/0047992 | A1 | 3/2007 | Kubo | |

FOREIGN PATENT DOCUMENTS

| | | |
|---|---|---|
| JP | 9-197764 | 7/1997 |
| JP | 10-49023 | 2/1998 |
| JP | 2000-89537 | 3/2000 |
| JP | 2003-5494 | 1/2003 |
| JP | 2003-177611 | 6/2003 |
| JP | 3733249 | 10/2005 |

OTHER PUBLICATIONS

Japanese Office Action mailed on May 26, 2009 directed at counterpart application No. 2007-147952;7 pages.
Extended European Search Report mailed on Sep. 30, 2008 directed towards counterpart foreign application No. 08010119; 7 pages.

* cited by examiner

*Primary Examiner* — William J Royer
(74) *Attorney, Agent, or Firm* — Morrison & Foerster LLP

(57) ABSTRACT

After-transfer remaining toner is reversely transferred from a transfer member to an image carrier. A toner collecting/charging device for temporarily collecting and charging the after-transfer remaining toner remaining on the transfer member includes a toner collecting/charging roller which is provided in such proximity to the transfer member as not to make contact with a primarily transferred toner image, and which has a collecting function of temporarily collecting the after-transfer remaining toner and a charging function of charging the after-transfer remaining toner to a specified polarity, power supplies which are so connected that a voltage in which an AC voltage is superimposed on a DC voltage is applied to the toner collecting/charging roller, and a selector switch for changing a waveform of the AC voltage so that the toner collecting/charging roller is switched between a toner-collecting mode and a toner-releasing mode.

13 Claims, 6 Drawing Sheets

DEVELOPER COLLECTING/CHARGING DEVICE, IMAGE FORMING APPARATUS AND CLEANING METHOD

RELATED APPLICATION

This application is based on Japanese Patent Application No. 2007-147952, the content of which is incorporated herein by reference.

BACKGROUND OF THE INVENTION

The present invention relates to a developer (developing agent) collecting/charging device to be used in electrophotographic image forming apparatuses such as printers, copiers and facsimiles, as well as to an image forming apparatus and a cleaning method using a developer collecting/charging member.

Conventionally, there have been known so-called 4-cycle full-color image forming apparatuses. Such an image forming apparatus includes a developing unit holding four developing devices corresponding to toners of four colors, yellow (Y), magenta (M), cyan (C) and black (K). With this developing unit rotated so that a developing device is moved to a development position facing an image carrier, an electrostatic latent image on the image carrier is developed by a first-color toner fed from the developing device, by which a toner image is formed on the image carrier. Then, the first-color toner image formed on the image carrier is primarily transferred onto a transfer belt as an example of a transfer member.

Upon termination of the toner image formation on the image carrier with the first-color toner, the developing unit is rotated so that a second-color developing device is moved to the development position, and a second-color toner image is formed on the image carrier by the toner fed from this developing device. Then, the second-color toner image is primarily transferred so as to be superimposed on the first-color toner image on the transfer belt.

Such an image formation process is performed also for the third- and fourth-color toners in succession so that the toner images are primarily transferred successively in superimposition on the first- and second-color toner images on the transfer belt.

A toner image composed of four-color toners, which has been formed in the way described above, is secondarily transferred onto a sheet of paper as a recording medium. The sheet on which the toner image has been secondarily transferred passes through a fixing member so as to have the toner image heated and fixed thereon, thereafter being discharged outside the apparatus. Thus, output of a full-color image is completed.

Provided that such a four-cycle image forming apparatus as described above includes a cleaning device which is provided therein so as to be movable into and out of contact with the transfer belt, the cleaning device that has withdrawn at a position away from the transfer belt during an image formation process is moved to a position where the cleaning device comes into contact with the transfer belt after the secondary transfer, by which toner remaining on the transfer belt after the secondary transfer is collected and cleaned by the cleaning device.

However, providing such a cleaning device for the transfer belt as described above would involve an additional need for a contact-and-separation drive mechanism, which would be an obstacle to the attainment of scale-down and cost reduction of the 4-cycle image forming apparatus.

JP H10-49023 A and JP 3733249 A disclose 4-cycle image forming apparatuses in which after-transfer remaining toner remaining on the transfer belt after the secondary transfer is reversely transferred onto the image carrier so as to be collected. In this case, with a view to facilitating the reverse transfer of the after-transfer remaining toner from the transfer belt to the image carrier, a voltage in which an AC voltage is superimposed on a DC voltage is applied to the after-transfer remaining toner by a charging roller so that the after-transfer remaining toner is uniformly charged to a polarity reverse to a normal polarity.

However, since the charging roller described in JP H10-49023 A and JP 3733249 A is located in such close proximity as to make contact with the transfer belt, the transfer belt may come into contact with, and disturb, the four-color toner image that is transferred one after another by four rotations of the transfer belt during the formation of a color image. For avoidance of this, the charging roller inevitably needs to be kept at a position withdrawn away from the transfer belt during the image formation, making it necessary to provide a contact-and-separation drive mechanism for the charging roller.

With the after-transfer remaining toner left in a large quantity, there are some cases where part of the after-transfer remaining toner is not charged to a polarity reverse to a normal polarity even if a voltage in which an AC voltage is superimposed on a DC voltage is applied by the charging roller. As a result, the after-transfer remaining toner that remains at the normal polarity is not reversely transferred to the image carrier, being uncollected, and could adversely affect the following image formation.

SUMMARY OF THE INVENTION

Accordingly, an object of the present invention is to provide a developer collecting/charging device, an image forming apparatus and a cleaning method each of which is capable of reversely transferring and collecting after-transfer remaining developer from a transfer member to an image carrier with reliability without providing any cleaning device for the transfer member and without requiring any contact-and-separation drive mechanism for the developer collecting/charging device for charging the after-transfer remaining developer.

In order to achieve the above object, according to a first aspect of the present invention, there is provided a developer collecting/charging device for temporarily collecting and charging after-transfer remaining developer that remains on a transfer member after a developer image primarily transferred from an image carrier onto the transfer member has been secondarily transferred onto a recording medium, so as to allow the after-transfer remaining developer to be reversely transferred to the image carrier and collected by a cleaning section, comprising:

a developer collecting/charging member which is provided in such proximity to the transfer member as not to make contact with the primarily transferred developer image, and which has a collecting function of temporarily collecting the after-transfer remaining developer and a charging function of charging the after-transfer remaining developer to a specified polarity;

a power supply which is so connected that a voltage in which an AC voltage is superimposed on a DC voltage is applied to the developer collecting/charging member; and a control section for changing a waveform of the AC voltage so that the developer collecting/charging member is switched between a developer-collecting mode and a developer-releasing mode.

In a second aspect of the invention, there is provided an image forming apparatus comprising:

an image carrier on a surface of which a developer image is to be formed;

a transfer member onto which the developer image is primarily transferred from the image carrier;

a secondary transfer section for secondarily transferring the primarily transferred developer image from the transfer member onto a recording medium;

a developer collecting/charging device for temporarily collecting and charging after-transfer remaining developer that remains on the transfer member after secondary transfer; and a cleaning section for collecting the after-transfer remaining developer reversely transferred from the transfer member to the image carrier, wherein the developer collecting/charging device includes: a developer collecting/charging member which is provided in such proximity to the transfer member as not to make contact with the primarily transferred developer image, and which has a collecting function of temporarily collecting the after-transfer remaining developer and a charging function of charging the after-transfer remaining developer to a specified polarity; a power supply which is so connected that a voltage in which an AC voltage is superimposed on a DC voltage is applied to the developer collecting/charging member; and a control section for changing a waveform of the AC voltage so that the developer collecting/charging member is switched between a developer-collecting mode and a developer-releasing mode.

Further, in a third aspect of the invention, there is provided a cleaning method for after-transfer remaining developer that remains on a transfer member after a developer image primarily transferred from an image carrier onto the transfer member has been secondarily transferred onto a recording medium, the method comprising the steps of: applying a specified voltage to the after-transfer remaining developer via a developer collecting/charging member which is placed in such proximity to the transfer member as not to make contact with the primarily transferred developer image, so that the after-transfer remaining developer is temporarily collected by the developer collecting/charging member and moreover charged to a specified polarity; thereafter reversely transferring the after-transfer remaining developer to the image carrier and then collecting the after-transfer remaining developer, wherein the specified voltage is a voltage in which an AC voltage is superimposed on a DC voltage, and a waveform of the AC voltage is changed so that the developer collecting/charging member is switched between a developer-collecting mode and a developer-releasing mode.

Still further, in a fourth aspect of the invention, there is provided an image forming apparatus comprising:

an image carrier which is rotationally driven;

an image forming section for forming a developer image on the image carrier;

a transfer member which is rotated in contact with the image carrier;

a primary transfer section which is placed opposite to the image carrier with the transfer member interposed therebetween and which transfers a developer image from the image carrier to the transfer member;

a cleaning section for collecting developer that remains on the image carrier after primary transfer;

a secondary transfer section which is placed on a downstream side of the primary transfer section in a rotational direction of the transfer member and which secondarily transfers a developer image from the transfer member onto a recording medium;

a roller which is placed on a downstream side of the secondary transfer section in the rotational direction of the transfer member and which is set with such a clearance to the transfer member as not to make contact with the developer image transferred onto the transfer member;

a first power supply for applying to the roller a DC voltage of same polarity as developer that forms an image on the image carrier;

a second power supply for applying an AC voltage of a certain waveform to the roller;

a third power supply for applying to the roller an AC voltage having a waveform different from that of the AC voltage applied by the second power supply; and a control section for switching among the first, second and third power supplies so that after voltages are kept applied to the roller from the first power supply and the second power supply for a specified time period, voltages are kept applied to the roller from the first power supply and the third power supply for a specified time period.

In the developer collecting/charging device, the image forming apparatus and the cleaning method according to the present invention, the developer collecting/charging member or the roller is provided in such proximity to or separation from the transfer member as not to make contact with the primarily transferred developer image, and therefore never contacts or disturbs the developer image primarily transferred on the transfer member during the image formation. As a result, with respect to the developer collecting/charging member or the roller, there is no need for providing any contact-and-separation drive mechanism for the transfer member, which can contribute to scale-down and cost reduction of the image forming apparatus.

Further, even with a large quantity of the after-transfer remaining developer, part of the after-transfer remaining developer is temporarily collected by the developer collecting/charging member that is in the developer-collecting mode or the roller to which voltages are applied from the first power supply and the second power supply. Accordingly, the after-transfer remaining developer that has decreased in its remaining amount can be charged to a polarity reverse to a normal polarity with reliability.

As a consequence, without providing any cleaning device for the transfer member, and without needing any contact-and-separation drive mechanism for the developer collecting/charging device that serves for charging of after-transfer remaining developer, the after-transfer remaining developer can be reversely transferred from the transfer member to the image carrier, thus being collected, with high reliability.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

In the following description for the embodiment, it is noted that the normal charging polarity of the toner as a developer is assumed as a negative polarity.

Figure 1:
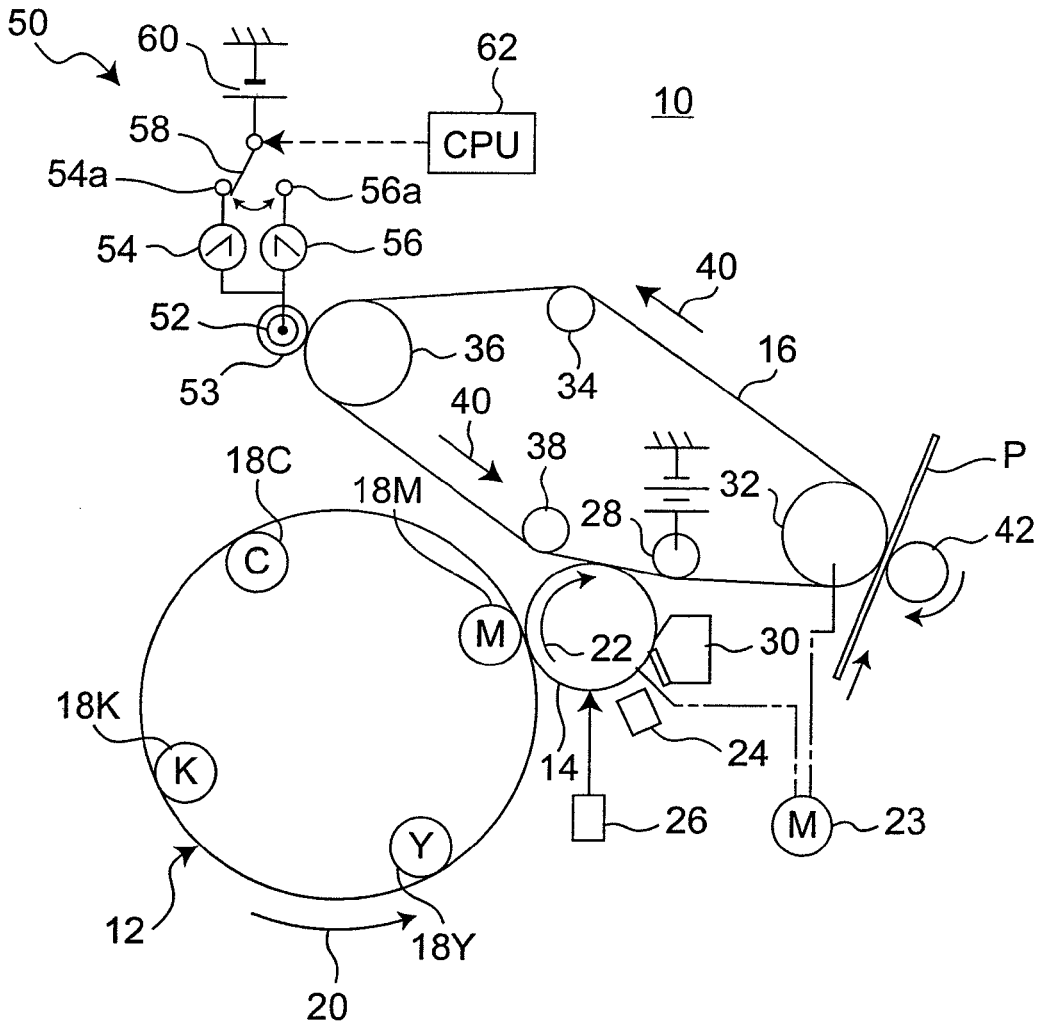
FIG. 1 is a schematic overall constructional view of an image forming apparatus.
Figure 2:
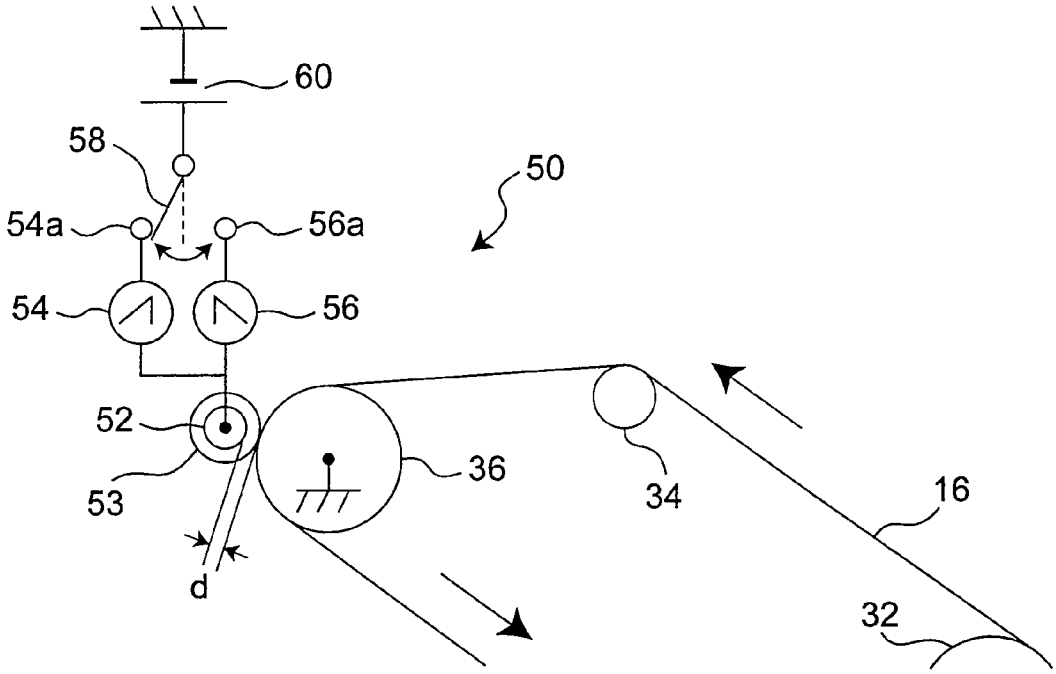
FIG. 2 is an enlarged view of a toner collecting/charging device.

FIG. 1 is a schematic constructional view of an image forming apparatus 10 which is an embodiment of the invention. FIG. 2 shows in enlargement a toner collecting/charging device (developer collecting/charging device) 50 in FIG. 1. The image forming apparatus 10 includes a developing unit (image forming section) 12, a photoconductor (image carrier) 14, and an intermediate transfer belt (transfer member) 16. It is noted that the transfer member 16 is not limited to a belt, and may be given in other forms (e.g., a drum).

The developing unit 12 includes four developing devices 18Y, 18M, 18C, 18K corresponding to four-color toners (developers) cyan (C), magenta (M), yellow (Y), black (K) in a circumferentially arrayed state. The developing unit 12 can be driven into rotation in a direction indicated by an arrow 20 (as well as in a direction opposite to this direction). From a developing device that has come to a development position facing the photoconductor 14 as a result of rotation of the developing unit 12, toner is fed so as to be deposited by electrostatic force onto an electrostatic latent image formed on a surface of the photoconductor 14, by which a toner image is formed. Although the normal polarity for the toner used in this embodiment is assumed to be the negative polarity, yet the present invention is applicable also to toners of which the normal polarity is a positive polarity.

The photoconductor 14, which is a well-known one having a photoconductive layer on a surface of a drum-shaped base body, can be driven by a main motor 23 into rotation in a direction indicated by an arrow 22. Around the photoconductor 14 are disposed, in order along its rotational direction, a charging device 24 for uniformly charging the surface of the photoconductor 14 to, e.g. −600 V, an exposure device 26 for exposing the surface of the uniformly charged photoconductor 14 to laser light to form an electrostatic latent image composed of voltage decayed portions (e.g., −50 V), a primary transfer roller (primary transfer section) 28 which is provided in adjacency to the photoconductor 14 with the intermediate transfer belt 16 interposed therebetween and to which a primary transfer bias is applied, and a cleaning device (cleaning section) 30 for, after primary transfer of a toner image onto the intermediate transfer belt 16 by an electrostatic action of the primary transfer roller 28, scraping and collecting toner remaining on the photoconductor 14.

The intermediate transfer belt 16, which is an endless belt made of resin film as an example, is driven into rotation in a direction indicated by an arrow 40 as, for example, a roller 32 is driven by the main motor 23 while the intermediate transfer belt 16 is supported by outer peripheral portions of five rollers 28, 32, 34, 36, 38, including the primary transfer roller 28, placed inside.

With respect to the rotational direction of the intermediate transfer belt 16, a secondary transfer roller (secondary transfer section) 42 to which a secondary transfer bias is applied by an unshown power supply is rotatably pressed on a surface portion of the intermediate transfer belt 16 which is on the downstream side of the photoconductor and which is supported by the roller 32. A contact portion between this secondary transfer roller 42 and the intermediate transfer belt 16 serves as a secondary transfer site. A toner image primarily transferred to the intermediate transfer belt 16 is secondarily transferred by electrostatic action of the secondary transfer roller 42 onto a sheet P as a recording medium to be introduced to the secondary transfer site at a specified timing.

The sheet P, onto which the toner image has been secondarily transferred, passes through an unshown fixing unit so as to have the toner image heated and fixed thereon, and is then discharged outside the image forming apparatus 10.

A toner collecting/charging device (developer collecting/charging device) 50 is provided in adjacency to a surface portion of the intermediate transfer belt 16 supported by the roller 36. The toner collecting/charging device 50 includes: a rotatable toner collecting/charging roller (developer collecting/charging member) 52 which is provided in such close proximity to the intermediate transfer belt 16 as not to make contact with the primarily transferred toner image and which has a collecting function of temporarily collecting after-transfer remaining toner (after transfer remaining developer) remaining on the intermediate transfer belt 16 after secondary transfer and a charging function of charging the after-transfer remaining toner to a specified polarity; a first AC power supply 54 (second power supply) and a second AC power supply (third power supply) 56 electrically connected to the toner collecting/charging roller 52; a selector switch 58 which is to be switched between first, second terminal portions 54*a*, 56*a* connected to the first, second AC power supplies 54, 56, respectively; and a DC power supply (first power supply) 60 connected to the selector switch 58. The selector switch 58 is changed over based on a signal inputted from a CPU 62. Also, the selector switch 58, as shown by broken line in FIG. 2, can be set in a neutral position where it makes contact with neither of the terminal portions 54*a*, 56*a*. In addition, in this embodiment, the selector switch 58 and the CPU 62 constitute a control section of this invention.

In the toner collecting/charging device 50 constructed as described above, to the toner collecting/charging roller 52, a first voltage in which the first AC voltage by the first AC power supply 54 is superimposed on the DC voltage by the DC power supply 60 is applied when the selector switch 58 is brought into contact with the first terminal portion 54*a*, and a second voltage in which the second AC voltage by the second AC power supply 56 is superimposed on the DC voltage by the DC power supply 60 is applied when the selector switch 58 is brought into contact with the second terminal portion 56*a*. In this case, a waveform of the first AC voltage and a waveform of the second AC voltage are shaped different from each other, details of which will be described later. Hereinafter, a state in which the first voltage is applied to the toner collecting/charging roller 52 will be referred to as "toner-collecting mode," ("developer-collecting mode") and a state in which the second voltage is applied to the toner collecting/charging roller 52 will be referred to as "toner-releasing mode" ("developer-releasing mode").

In this embodiment, the first voltage and the second voltage are applied by using two AC power supplies 54, 56 that generate AC voltages different in waveform from each other. However, instead of this, one high-voltage transformer which can be controlled by software for voltage value, waveform, frequency, duty ratio and the like may be used to generate the first voltage and the second voltage based on a voltage value and a waveform stored in memory of the control section.

Figure 3:
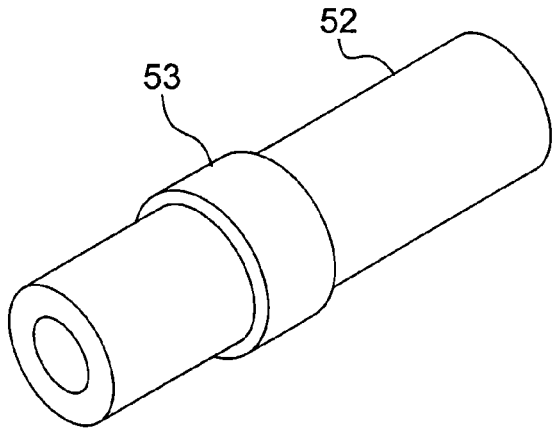
FIG. 3 is an enlarged perspective view of one end portion of a toner collecting/charging roller.

As shown in FIG. 3, the toner collecting/charging roller 52 is a cylindrical-shaped roller made of a semiconductive material of, e.g., about $10^7$-$10^8\Omega$ and, more specifically, it may be formed by coating an outer peripheral surface of a metalliccylinder cored bar with semiconductive rubber (e.g., EPDM (Ethylene Propylene Diene Monomer)). At proximities to both end portions of the toner collecting/charging roller 52, for example, PET film rings 53 (only one of them is shown) each having a thickness of, e.g., 150 μm are affixed, respectively. These film rings 53 are set in contact with both side portions of the intermediate transfer belt 16 corresponding to non-image-formation regions, respectively, so that the toner collecting/charging roller 52 is provided in proximity to the intermediate transfer belt 16, but with a distance d of 150 μm corresponding to the thickness of each film ring 53 provided from the intermediate transfer belt 16.

The distance d, although exemplified by 150 μm above, is yet preferably not less than 20 μm for the purpose of avoiding contact with a plural-color toner image that is to be primarily transferred onto the intermediate transfer belt 16 in superimposition during the image formation, while the distance d is preferably set not more than 200 μm, which is a distance at which relatively uniform discharge is generated between the toner collecting/charging roller 52 and the intermediate transfer belt 16 even in any environmental conditions from low-temperature, low-humidity to high-temperature, high humidity conditions, as will be described in conjunction with later-described cleaning operations.

Also, in order that the after-transfer remaining toner remaining on the intermediate transfer belt 16 after the secondary transfer is charged to more or less uniform potential as will be described later, an AC voltage $V_{P\text{-}P}$ contained in the voltage applied to the toner collecting/charging roller 52 for generation of discharge in a most proximal portion (i.e., in the space of the distance d) between the toner collecting/charging roller 52 and the intermediate transfer belt 16 is, preferably, a value that satisfies that $V_{P\text{-}P}>2\times(6.2d+312)$. However, actually, since the intermediate transfer belt 16, which is a resistive material, has a potential, values lower than those which satisfy the foregoing conditional equation may be used for the AC voltage value.

Next, an image forming operation for a color image in the image forming apparatus 10 having the above construction is explained.

When color image data is inputted to the CPU 62 together with a print command from an external unit such as a personal computer or the like, the CPU 62 performs a data development process of color image data into Y, M, C, K color data, and outputs a signal to the exposure device 26 to instruct laser exposure of the photoconductor 14 based on these individual color data.

First, the surface of the photoconductor 14 driven into rotation in the direction of the arrow 22 is uniformly charged by the charging device 24 to, for example, —600 V, and the surface of the uniformly charged photoconductor 14 is exposed to laser light based on cyan data by the exposure device 26, by which an electrostatic latent image formed of a voltage decayed portion of, e.g., −50 V is formed.

At that time point, with the developing unit 12 rotationally driven, the developing device 18C has been located at the development position, by which cyan toner is fed to the electrostatic latent image on the photoconductor surface so that a cyan toner image is formed. This cyan toner image is primarily transferred from the photoconductor 14 to the intermediate transfer belt 16. It is noted that toner remaining on the photoconductor 14 after the primary transfer is collected by the cleaning device 30.

Thereafter, also for magenta, yellow and black, toner images are formed, respectively, by similar process one after another, and primarily transferred from the photoconductor 14 to the intermediate transfer belt 16 in superimposition one after another.

In this image formation, the toner collecting/charging roller 52 is positioned in proximity to the intermediate transfer belt 16 with a specified gap thereto. Therefore, the toner collecting/charging roller 52 is prevented from contacting and disturbing the toner image on the intermediate transfer belt 16 during the image formation.

The four-color toner images primarily transferred on the intermediate transfer belt 16 in the way described above are secondarily transferred collectively onto the sheet P introduced to the secondary transfer site at a specified timing from below. Thereafter, the sheet P, after having the toner image melted and fixed thereto during passage through the fixing unit, is discharged outside the image forming apparatus 10 (e.g., into a discharged paper tray provided on the top or side face).

Next, cleaning operation for after-transfer remaining toner remaining on the intermediate transfer belt after the secondary transfer by using the toner collecting/charging device 50 in the image forming apparatus 10 is described.

During such color-image formation operation as described above, the selector switch 58 is kept at a neutral position where it is in contact with neither of the terminal portions 54*a*, 56*a*, so that no voltage is applied to the toner collecting/charging roller 52. After the four-color toner image has been secondarily transferred from the intermediate transfer belt 16 to the sheet P in response to a command from the CPU 62, the selector switch 58 is switched so as to come into contact with either of the terminal portions 54*a*, 56*a*, so that a toner-collecting mode or a toner-releasing mode is executed.

The toner-collecting mode is executed during a period from completion of a secondary transfer to a primary transfer a next-printing-object image onto the intermediate transfer belt 16, and, without no next image, from the secondary transfer to expiration of a specified time. On the other hand, the toner-releasing mode is executed at a start time (when the image forming apparatus 10 is powered on for start-up) and at an end sequence time (when no image to be next printed is present upon termination of a sequence of image forming operations). In the case of an end sequence, the toner-releasing mode is executed after the toner-collecting mode is executed from the secondary transfer to expiration of the specified time under the condition that no image to be next printed is present.

Figure 4:
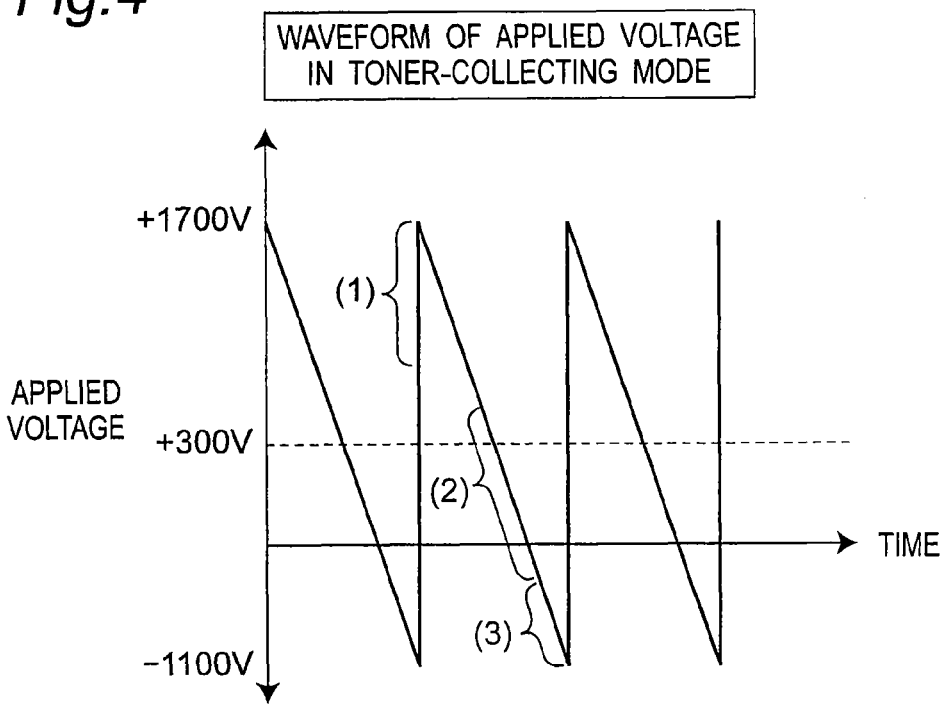
FIG. 4 is a view showing a waveform of a first voltage for a toner-collecting mode.

As described above, the toner-collecting mode is executed after a four-color toner image on the intermediate transfer belt 16 is secondarily transferred onto the sheet P, by which part of the after-transfer remaining toner on the intermediate transfer belt 16 is collected. In the toner-collecting mode, the selector switch 58 is switched to a state in which it is in contact with the first terminal portion 54*a*, by which the first voltage is applied to the toner collecting/charging roller 52. FIG. 4 shows a waveform of the first voltage as a concrete example. This first voltage is a voltage in which a first AC voltage of a sawtooth waveform having a value of $V_{P\text{-}P}$, 2800 V, and a frequency of 1250 Hz by the first AC power supply 54 is superimposed on a DC voltage of +300 V by the DC power supply 60. The frequency, given as 1250 Hz above, depends on the process speed (125 mm/sec. in this embodiment) of the image forming apparatus 10, and is preferably set so as to satisfy that process speed (mm/sec.)/frequency (Hz)≦1 (mm).

The waveform of the first voltage is a sawtooth-shaped one in which rise time and fall time differ from each other. Specifically, the rise time is set relatively short and the fall time is set relatively long and, more specifically, the voltage value rises instantly from −1100 V to +1700 V at a rising section, and relatively slowly changes from +1700 V to −1100 V at a falling section. In other words, the waveform of the first voltage is characterized by an abrupt change in the transition from the voltage of −1100 V of the same polarity as the toner that forms the image, to the voltage of +1700 V of the same polarity, and by a slow change in the transition from the voltage of +1700 V of the reverse polarity to the toner that forms the image, to the voltage of −1100 V of the same polarity.

In a voltage region indicated by (1) in a rising section of this waveform, there occurs a positive-side discharge between the toner collecting/charging roller 52 and the intermediate transfer belt 16, by which the after-transfer remaining toner is charged to a positive voltage, reverse in polarity to the normal charging polarity. In a voltage region indicated by (2) in a succeeding falling section, without the occurrence of any discharge between the toner collecting/charging roller 52 and the intermediate transfer belt 16, an electric field of such a direction that the positively charged after-transfer remaining toner on the intermediate transfer belt 16 is moved toward the toner collecting/charging roller 52 is formed, by which part of the after-transfer remaining toner is moved and stuck, and temporarily collected, to the outer peripheral surface of the rotating toner collecting/charging roller 52. In a voltage region indicated by (3) of a further succeeding falling section, there occurs a negative-side discharge between the toner collecting/charging roller 52 and the intermediate transfer belt 16, by which the after-transfer remaining toner is charged to a negative voltage. Subsequently, during a change process from the voltage region of (3) to the voltage region of (1), there is an instant when an electric field acts in such a direction that the after-transfer remaining toner negatively charged between the toner collecting/charging roller 52 and the intermediate transfer belt 16 is moved to the toner collecting/charging roller 52. However, since this instant is a nearly zero time period, the positive-side discharge in the voltage region (1) starts so that the toner is positively charged before the toner is moved, with the result that the move of the after-transfer remaining toner to the toner collecting/charging roller 52 does not occur during this process.

By such an action as described above, the after-transfer remaining toner is partly collected by the toner collecting/charging roller 52, thus being decreased in quantity. As a result, the after-transfer remaining toner passing through the region opposed to the toner collecting/charging roller 52 can be put into a positively charged state, which is of the reverse polarity to the normal polarity, with higher reliability.

Now the phenomenon that the after-transfer remaining toner is positively charged during its passage through the region opposed to the toner collecting/charging roller 52, to which the first voltage is applied, is expanded in detail. As described above, a positive discharge and a negative discharge alternately occur at the most proximal portion between the toner collecting/charging roller 52 and the intermediate transfer belt 16. Then, since the outer peripheral surface of the toner collecting/charging roller 52 has a curvature, the distance between the toner collecting/charging roller 52 and the intermediate transfer belt 16 gradually increases toward the downstream direction from the most proximal portion with respect to the movement direction of the intermediate transfer belt 16. As the distance between the toner collecting/charging roller 52 and the intermediate transfer belt 16 increases like this, the strength of the electric field formed therebetween also weakens gradually until such a discharge as described above no longer occurs. However, the position where the discharge comes not to occur any more is still quite proximate to the toner collecting/charging roller 52, so that the after-transfer remaining toner is charged to a positive voltage together with the surface of the intermediate transfer belt 16, which is a resistive material, by the action of the DC voltage of +300 V contained in the first voltage.

The after-transfer remaining toner positively charged by the toner collecting/charging roller 52 in the way described above is moved to a position of contact with the photoconductor 14 along with the rotation of the intermediate transfer belt 16 and, at that position, electrically adsorbed and thus reversely transferred to the photoconductor 14 having the surface voltage of −600 V except its electrostatic latent image portion, thereafter being collected by the cleaning device 30. As will be described later, in order that the positively charged after-transfer remaining toner is reversely transferred from the intermediate transfer belt 16 to the photoconductor 14 with more reliability, it is preferable that with a transfer bias of the positive polarity applied to the primary transfer roller 28, a force is made to electrostatically act on the after-transfer remaining toner in such a direction as to thrust the after-transfer remaining toner toward the photoconductor 14.

On the other hand, at a start or end sequence, the CPU 62 switches the selector switch 58 into contact with the second terminal portion 56*a*. As a result of this, the second voltage is applied to the toner collecting/charging roller 52, by which the toner-releasing mode is executed.

Figure 5:
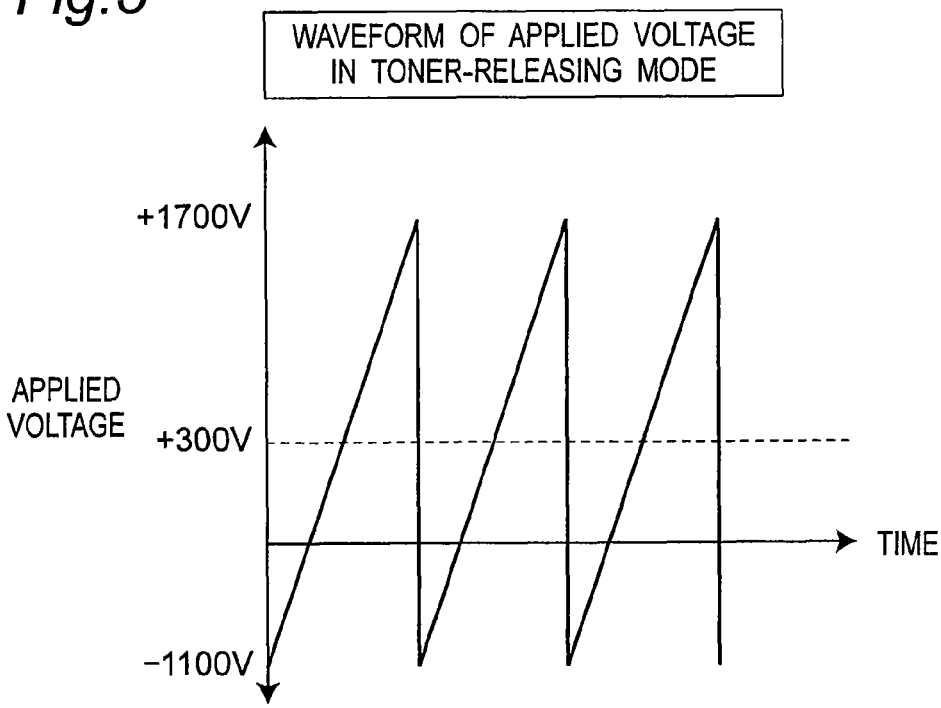
FIG. 5 is a view showing a waveform of a second voltage for a toner-releasing mode.

FIG. 5 shows a waveform of the second voltage as a concrete example. This second voltage is a voltage in which a second AC voltage of a sawtooth waveform having a value of $V_{P\text{-}P}$, 2800 V, and a frequency of 1250 Hz by the second AC power supply 56 is superimposed on a DC voltage of +300 V by the DC power supply 60. The waveform of this second AC voltage also is a sawtooth-shaped one in which rise time and fall time differ from each other, but has a waveform different from that of the first AC voltage.

More specifically, the waveform of the second voltage, converse to the waveform of the first voltage, is such that the rise time is set relatively long and the fall time is set relatively short, and that the voltage value rises slowly from −1100 V to +1700 V at a rising section, and instantly changes from +1700 V to −1100 V at a falling section. In other words, the waveform of the second voltage is characterized by a slow change in the transition from the voltage of −1100 V of the same polarity as the toner that forms the image, to the voltage of +1700 V of the same polarity, and by an abrupt change in the transition from the voltage of +1700 V of the reverse polarity to the toner that forms the image, to the voltage of −1100 V of the same polarity.

When such a second voltage as shown above is applied to the toner collecting/charging roller 52, the after-transfer remaining toner temporarily collected during image formation is released from the toner collecting/charging roller 52 onto the intermediate transfer belt 16 by an action reverse to that in the image formation, and moved to a position of contact with the photoconductor 14 along with the rotation of the intermediate transfer belt 16 in a state that the after-transfer remaining toner is positively charged by an action similar to that for the first voltage. Then, at that position, the after-transfer remaining toner is electrically adsorbed and thus reversely transferred to the photoconductor 14 having the surface voltage of −600 V except its electrostatic latent image portion, and thereafter collected by the cleaning device 30.

Figure 6:
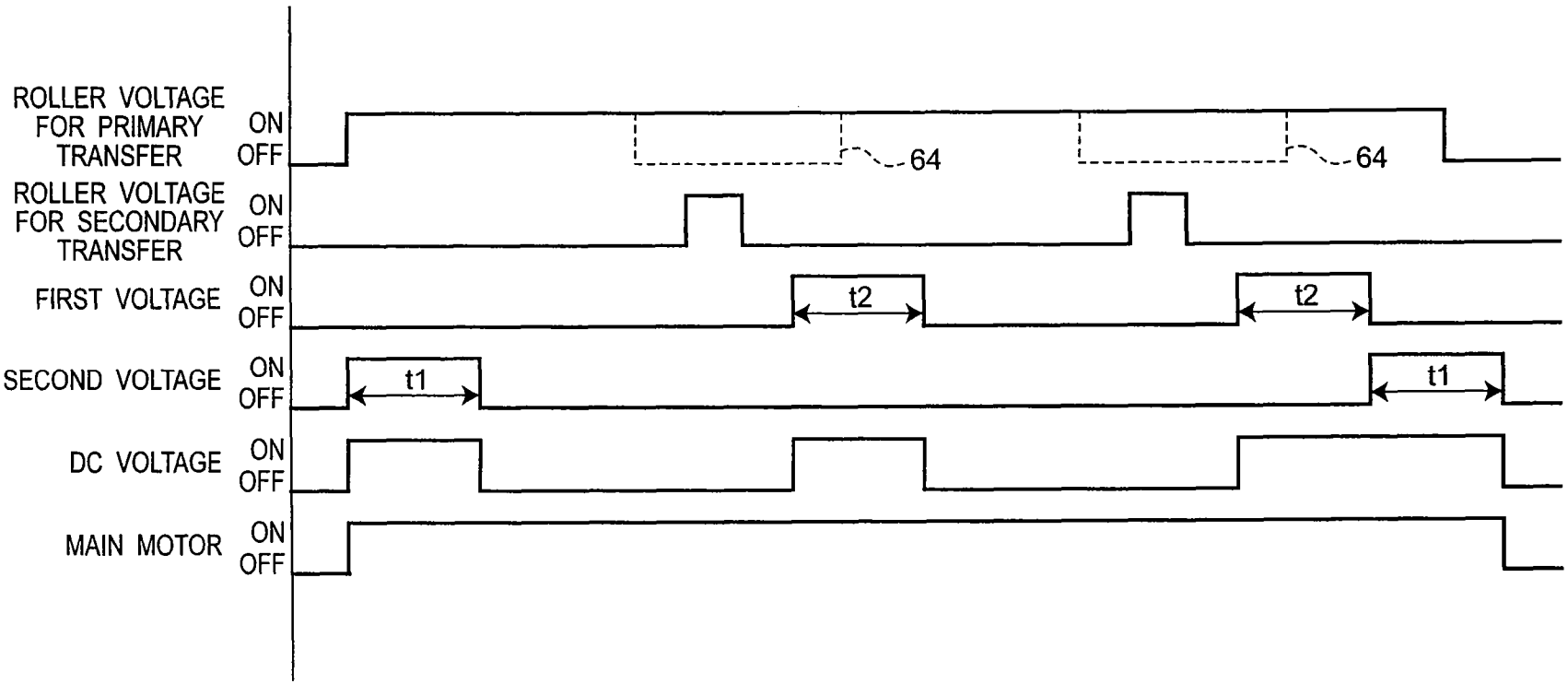
FIG. 6 is a timing chart showing the toner-collecting and toner-releasing modes.

Next, the execution timing for each of the toner-collecting mode and the toner-releasing mode is expanded with reference to the timing chart of FIG. 6. This timing chart shows an example in which two color images are printed in succession.

When a print signal is inputted to the image forming apparatus 10, the main motor 23 is turned on so that the photoconductor 14, the intermediate transfer belt 16 and the like are started to be rotationally driven, while the primary transfer roller voltage is turned on, so that a toner image formed on the photoconductor 14 can be primarily transferred onto the intermediate transfer belt 16. In synchronization with this, the second voltage is applied for a specified time period t1. The reason for applying the second voltage of the toner-releasing mode is that the after-transfer remaining toner, if it has been kept temporarily collected to the toner collecting/charging roller 52 at a time of printing of the preceding job, is released onto the intermediate transfer belt 16 so as to be collected by the cleaning device 30 via the photoconductor 14.

After completion of the transfer of the four-color toner image onto the intermediate transfer belt 16, at a timing when the four-color toner image has almost reached the secondary transfer site along with rotation of the intermediate transfer belt 16, the secondary transfer roller voltage is applied to the secondary transfer roller 42, by which the four-color toner image is secondarily transferred onto the sheet P.

It is allowable that the primary transfer voltage is kept turned off during an interval from an end of the primary transfer of the four-color toner image onto the intermediate transfer belt 16 to execution of primary transfer for a next image as shown by broken line 64 in FIG. 6. However, it is preferable that the primary transfer voltage is kept turned on even during a time zone between one image and another in order that the toner released to the intermediate transfer belt 16 at an end sequence of the preceding printing can reliably be reversely transferred and collected to the photoconductor 14, as described above.

After the secondary transfer, the first voltage is turned on, and kept as it is for a specified time period t2, at a timing when the region with the after-transfer remaining toner present thereon has almost reached a position opposed to the toner collecting/charging roller 52 along with the rotation of the intermediate transfer belt 16, during which the toner-collecting mode is executed. The specified time period t2 is, preferably, longer than at least the time required for the intermediate transfer belt 16 to turn around by one cycle. The reason of this is to allow the collection of the after-transfer remaining toner via the photoconductor to be reliably carried out all around the intermediate transfer belt 16.

After a second four-color toner image is secondarily transferred from the intermediate transfer belt 16 to the sheet P and further after the toner-collecting mode has been executed for the specified time period t2, the applied voltage to the toner collecting/charging roller 52 is switched to the second voltage, which is kept applied for the specified time period t1 while the toner-releasing mode is executed. Thus, upon an end of a sequence of printing operations, the toner-releasing mode is executed before the image forming apparatus 10 is halted (put into a standby state) so that the after-transfer remaining toner primarily collected to the toner collecting/charging roller 52 is collected via the intermediate transfer belt 16 and the photoconductor 14. As a result, it becomes possible to shorten first print time, which is the time elapsing from reception of a next-job print command until output of a first-sheet image.

In synchronization with an end of the toner-releasing mode, the main motor 23 is turned off so that the image forming apparatus 10 is halted. The primary transfer roller voltage, although preferably kept turned on to collect the after-transfer remaining toner remaining on the intermediate transfer belt 16 to the photoconductor 14, is turned off earlier than a motor halt (more accurately, turn-off of the charging device 24) so as not to cause transfer memory to the photoconductor 14 due to the primary transfer bias.

In the above-described example, after an end of the secondary transfer, both collection and release of the after-transfer remaining toner by the toner collecting/charging roller 52 are performed before the image forming apparatus 10 is halted. However, without being limited to this, after an end of the secondary transfer, the image forming apparatus 10 may be halted after only the collection of the after-transfer remaining toner is performed, after which the release of the after-transfer remaining toner may be done at a time point when a next print signal is inputted. Otherwise, after an end of the secondary transfer, the image forming apparatus 10 may be halted as it is, after which collection and release of the after-transfer remaining toner may be done at a time point when a next print command is inputted.

As described above, according to the image forming apparatus 10 of this embodiment, the toner collecting/charging roller 52 is provided in such proximity to the intermediate transfer belt 16 as not to make contact with a primarily transferred toner image, and therefore never contacts or disturbs the primarily transferred toner image during the image formation. As a result, there is no need for providing a contact-and-separation drive mechanism for the toner collecting/charging roller 52, contributing to scale-down and cost reduction of the image forming apparatus 10.

Also, even with a large quantity of the after-transfer remaining toner, part of the after-transfer remaining toner is collected by the toner collecting/charging roller 52 that is in the toner-collecting mode with the first voltage applied. Accordingly, the after-transfer remaining toner that has decreased in its remaining amount can be positively charged to a polarity reverse to a normal polarity with reliability.

As a consequence, without providing any cleaning device for the intermediate transfer belt 16, and without needing any contact-and-separation drive mechanism for the toner collecting/charging roller 52 that serves for charging of after-transfer remaining toner, the after-transfer remaining toner can be reversely transferred from the intermediate transfer belt 16 to the photoconductor 14, thus being collected, with high reliability.

The present invention is not limited to the contents of the description of the foregoing embodiment, and may be modified and changed in various ways within the scope of the technical concept of the invention.

Figures 7A, 7B, 7C:
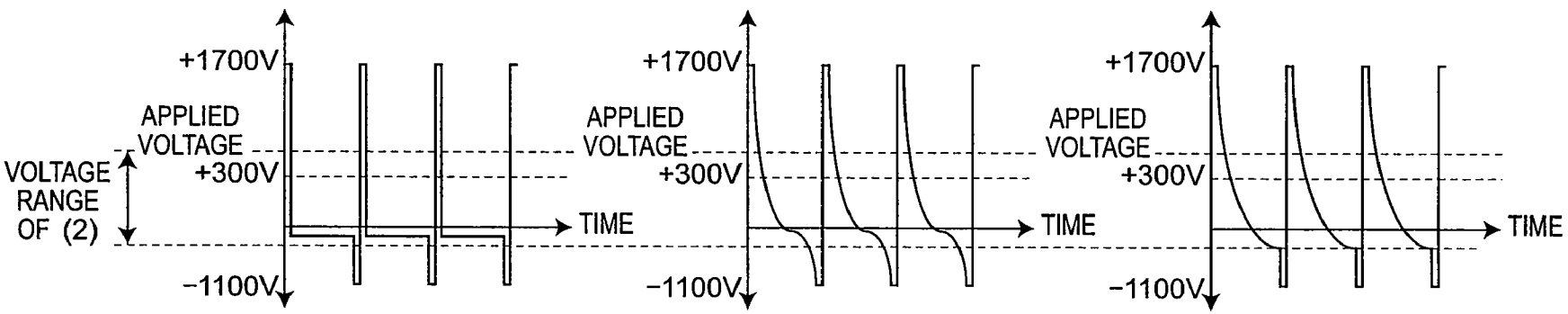
FIGS. 7A to 7C are views showing waveforms of three-type modifications of the first voltage.

For instance, the waveform of the first voltage shown in FIG. 4 to be used in the toner-collecting mode has been so assumed that its rising section and falling section are given each in the form of one straight line, but may be so formed that the rising section and the falling section are different in waveform shape from each other. In this case, the waveform is preferably so set that the region indicated by (2) in FIG. 4 has more negative-side portion as much as possible in time base with a view to allowing for longer time to be taken for moving the toner to the toner collecting/charging roller 52. For example, with respect to the first voltage, whereas its rising section is in one straight line, the falling section may be set constant on the negative side of +300 V over the region (2) as shown in FIG. 7A, or the falling section has a point of inflection near an about zero-volt point in the region (2) as shown in FIG. 7B, or the falling section may be so formed as to be curved up to about the lower limit of the region (2) as shown in FIG. 7C. It is noted that waveforms obtained by inverting the waveforms shown in FIGS. 7A-7C, respectively, up and down on a center of +300 V are those of the second voltage for the toner-releasing mode.

Also, since the image forming apparatus 10 normally includes a temperature sensor and a humidity sensor, control for changing the values of $V_{P-P}$ for the first and second voltages may be performed based on a temperature and a humidity detected by these sensors. For example, it is permissible that the value of $V_{P-P}$ is set smaller than a normal one under high temperature and high humidity conditions in which discharge is more likely to occur, while, conversely, the value of $V_{P-P}$ is set larger than the normal one under low temperature and low humidity conditions in which discharge is less likely to occur.

Figure 8:
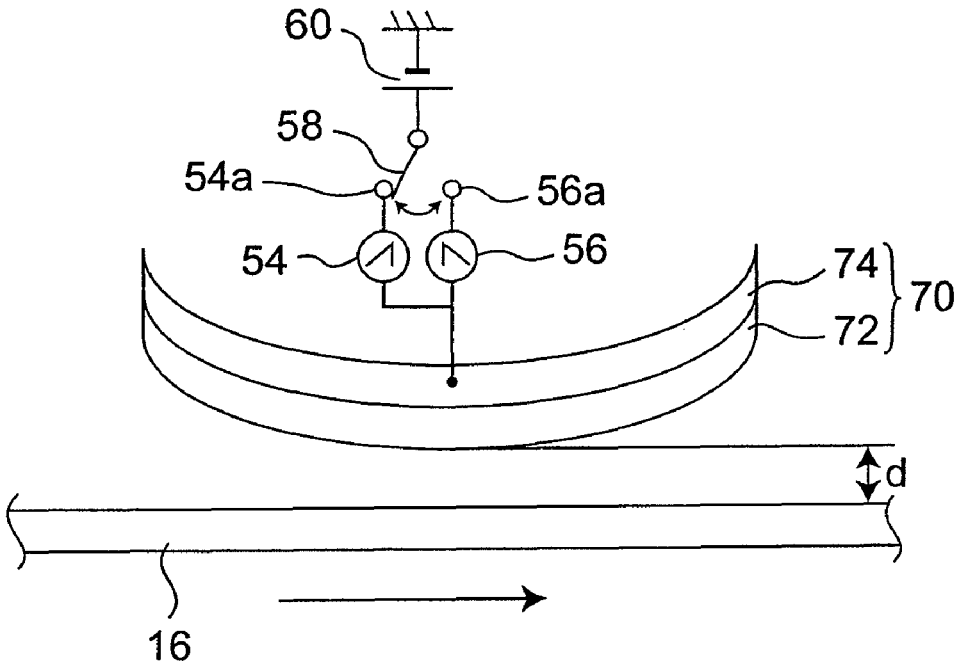
FIG. 8 is a view showing a modification of a toner collecting/charging member.

Furthermore, the toner collecting/charging member is not limited to roller-shaped ones, and may be provided in other shapes. For example, as shown in FIG. 8, a curved plate-shaped toner collecting/charging member 70 may be used. The toner collecting/charging member 70 has a two-layered structure of a resistive layer 72 facing the intermediate transfer belt 16, and a conductive, layer 74 provided on its rear surface.

Although the present invention has been fully described by way of examples with reference to the accompanying drawings, it is to be noted that various changes and modifications will be apparent to those skilled in the art. Therefore, unless otherwise such changes and modifications depart from the spirit and the scope of the present invention, they should be construed as being included therein.

What is claimed is:

1. A developer collecting/charging device for temporarily collecting and charging after-transfer remaining developer that remains on a transfer member after a developer image primarily transferred from an image carrier onto the transfer member has been secondarily transferred onto a recording medium, so as to allow the after-transfer remaining developer to be reversely transferred to the image carrier and collected by a cleaning section, comprising:

a developer collecting/charging member which is provided in such proximity to the transfer member as not to make contact with the primarily transferred developer image, and which has a collecting function of temporarily collecting the after-transfer remaining developer and a charging function of charging the after-transfer remaining developer to a specified polarity;

a power supply which is so connected that a voltage in which an AC voltage is superimposed on a DC voltage is applied to the developer collecting/charging member; and a control section for changing a waveform of the AC voltage so that the developer collecting/charging member is switched between a developer-collecting mode and a developer-releasing mode.

2. The developer collecting/charging device as claimed in claim 1, wherein a polarity of the DC voltage is reverse to a normal charging polarity of the developer.

3. The developer collecting/charging device as claimed in claim 1, wherein the waveform of the AC voltage is changed so that its rise time and fall time differ from each other.

4. The developer collecting/charging device as claimed in claim 1, wherein the waveform of the AC voltage has a difference in shape between its rising section and falling section.

5. The developer collecting/charging device as claimed in claim 1, wherein the switching of the waveform of the AC voltage is executed according to image formation conditions.

6. An image forming apparatus comprising:

an image carrier on a surface of which a developer image is to be formed;

a transfer member onto which the developer image is primarily transferred from the image carrier;

a secondary transfer section for secondarily transferring the primarily transferred developer image from the transfer member onto a recording medium;

a developer collecting/charging device for temporarily collecting and charging after-transfer remaining developer that remains on the transfer member after secondary transfer; and a cleaning section for collecting the after-transfer remaining developer reversely transferred from the transfer member to the image carrier, wherein the developer collecting/charging device includes: a developer collecting/charging member which is provided in such proximity to the transfer member as not to make contact with the primarily transferred developer image, and which has a collecting function of temporarily collecting the after-transfer remaining developer and a charging function of charging the after-transfer remaining developer to a specified polarity; a power supply which is so connected that a voltage in which an AC voltage is superimposed on a DC voltage is applied to the developer collecting/charging member; and a control section for changing a waveform of the AC voltage so that the developer collecting/charging member is switched between a developer-collecting mode and a developer-releasing mode.

7. The image forming apparatus as claimed in claim 6, further comprising a rotatable developing unit having a plurality of developing devices corresponding to a plurality of colors of developers, respectively, wherein a developer image is formed on the image carrier by a developing device which has been moved to a development position opposite to the image carrier by rotation of the developing unit.

8. A cleaning method for after-transfer remaining developer that remains on a transfer member after a developer image primarily transferred from an image carrier onto the transfer member has been secondarily transferred onto a recording medium, the method comprising the steps of: applying a specified voltage to the after-transfer remaining developer via a developer collecting/charging member which is placed in such proximity to the transfer member as not to make contact with the primarily transferred developer image, so that the after-transfer remaining developer is temporarily collected by the developer collecting/charging member and moreover charged to a specified polarity; thereafter reversely transferring the after-transfer remaining developer to the image carrier and then collecting the after-transfer remaining developer, wherein the specified voltage is a voltage in which an AC voltage is superimposed on a DC voltage, and a waveform of the AC voltage is changed so that the developer collecting/charging member is switched between a developer-collecting mode and a developer-releasing mode.

9. An image forming apparatus comprising:

an image carrier which is rotationally driven;

an image forming section for forming a developer image on the image carrier;

a transfer member which is rotated in contact with the image carrier;

a primary transfer section which is placed opposite to the image carrier with the transfer member interposed therebetween and which transfers a developer image from the image carrier to the transfer member;

a cleaning section for collecting developer that remains on the image carrier after primary transfer;

a secondary transfer section which is placed on a downstream side of the primary transfer section in a rotational direction of the transfer member and which secondarily transfers a developer image from the transfer member onto a recording medium;

a roller which is placed on a downstream side of the secondary transfer section in the rotational direction of the transfer member and which is set with such a clearance to the transfer member as not to make contact with the developer image transferred onto the transfer member;

a first power supply for applying to the roller a DC voltage of same polarity as developer that forms an image on the image carrier;

a second power supply for applying an AC voltage of a certain waveform to the roller;

a third power supply for applying to the roller an AC voltage having a waveform different from that of the AC voltage applied by the second power supply; and a control section for switching among the first, second and that third power supplies so that after voltages are kept applied to the roller from the first power supply and the second power supply for a specified time period, voltages are kept applied to the roller from the first power supply and the third power supply for a specified time period.

10. The image forming apparatus as claimed in claim 9, wherein the specified time period for which voltages are kept applied to the roller from the first power supply and the second power supply is at least longer than a time duration taken for the transfer member to turn around by one rotation.

11. The image forming apparatus as claimed in claim 9, wherein after a developer image has been transferred to the recording medium by the secondary transfer section, the control section performs such control that voltages are applied to the roller from the first power supply and the second power supply for a specified time period and, thereafter, voltages are applied to the roller from the first power supply and the third power supply for a specified time period.

12. The image forming apparatus as claimed in claim 9, wherein a waveform of the AC voltage applied by the second power supply is characterized by an abrupt change of voltage in a transition from the voltage of the same polarity as that of the developer that forms the image, to the voltage of the reverse polarity, and by a slow change of voltage in a transition from the voltage of the reverse polarity, to the voltage of the same polarity as that of the developer that forms the image.

13. The image forming apparatus as claimed in claim 12, wherein the waveform of the AC voltage applied by the third power supply is characterized by an abrupt change of voltage in a transition from the voltage of the reverse polarity to that of the developer that forms the image, to the voltage of the same polarity, and by a slow change of voltage in a transition from the voltage of the same polarity as that of the developer that forms the image, to the voltage of the reverse polarity.

* * * * *

UNITED STATES PATENT AND TRADEMARK OFFICE

CERTIFICATE OF CORRECTION

PATENT NO. : 8,041,249 B2
APPLICATION NO. : 12/132418
DATED : October 18, 2011
INVENTOR(S) : Kazuyoshi Hara It is certified that error appears in the above-identified patent and that said Letters Patent is hereby corrected as shown below:

At column 15, claim 9, line 20, please delete the first word "that"

Signed and Sealed this
Sixth Day of December, 2011

David J. Kappos

David J. Kappos
*Director of the United States Patent and Trademark Office*